US011859811B2

(12) United States Patent
Vasudevan et al.

(10) Patent No.: US 11,859,811 B2
(45) Date of Patent: Jan. 2, 2024

(54) AUXILIARY BOILER SYSTEMS AND METHODS OF OPERATING AND IMPLEMENTING SAME

(71) Applicant: The Cleaver-Brooks Company, Inc., Thomasville, GA (US)

(72) Inventors: Meenatchinathan Vasudevan, Lincoln, NE (US); Dillon Gushard, Lincoln, NE (US); Nick Ferguson, Lincoln, NE (US); Paul Brown, Lincoln, NE (US)

(73) Assignee: The Cleaver-Brooks Company, Inc., Thomasville, GA (US)

( * ) Notice: Subject to any disclaimer, the term of this patent is extended or adjusted under 35 U.S.C. 154(b) by 0 days.

(21) Appl. No.: 17/688,443

(22) Filed: Mar. 7, 2022

(65) Prior Publication Data

US 2022/0290855 A1 Sep. 15, 2022

Related U.S. Application Data

(60) Provisional application No. 63/158,617, filed on Mar. 9, 2021.

(51) Int. Cl.
*F22B 33/00* (2006.01)
*F22B 37/22* (2006.01)

(52) U.S. Cl.
CPC ..... *F22B 33/00* (2013.01); *F22B 37/228* (2013.01)

(58) Field of Classification Search
CPC .... F01K 7/38; F01K 7/40; C02F 1/488; C02F 1/444; C02F 1/20; C02F 1/42; C02F 2303/22; C02F 2101/203
See application file for complete search history.

(56) References Cited

U.S. PATENT DOCUMENTS 1,866,893 A * 7/1932 La Mont ..... F22G 7/14 122/479.1
3,465,726 A 9/1969 Gerst
3,543,733 A 12/1970 Russo, Jr.
(Continued)

FOREIGN PATENT DOCUMENTS

CA 2794735 5/2013
CN 106195996 12/2016
(Continued)

*Primary Examiner* — Shafiq Mian
(74) *Attorney, Agent, or Firm* — Amundsen Davis, LLC

(57) ABSTRACT

Auxiliary boiler systems, and methods of implementing and/or operating auxiliary boiler systems, are disclosed herein. In one example embodiment, an auxiliary boiler system for use in conjunction with a main steam source includes an auxiliary boiler, a deaerator coupled directly to and integrated with the auxiliary boiler, and a condensate storage tank coupled at least indirectly to the deaerator. Also, in another example embodiment, a method of implementing an auxiliary boiler system for use in conjunction with a main steam source includes setting a condensate storage tank in relation to a first support structure at a first position, and setting an auxiliary boiler at a second position. The method further includes directly coupling a deaerator to the auxiliary boiler so that the deaerator is integrated with the auxiliary boiler, and installing at least one interconnection by which the condensate storage tank is at least indirectly coupled to the deaerator.

16 Claims, 6 Drawing Sheets

(56) References Cited

U.S. PATENT DOCUMENTS

| | | | | |
|---|---|---|---|---|
| 3,965,675 | A * | 6/1976 | Martz | F01K 13/02 60/39.182 |
| 4,228,767 | A | 10/1980 | Smith et al. | |
| 4,364,232 | A * | 12/1982 | Sheinbaum | E21B 43/40 166/372 |
| 5,558,047 | A | 9/1996 | Vetterick | |
| 6,095,096 | A | 8/2000 | Vetterick et al. | |
| 7,334,542 | B2 | 2/2008 | Zorzit et al. | |
| 8,281,752 | B2 | 10/2012 | English | |
| 9,494,054 | B2 | 11/2016 | Edelmann et al. | |
| 9,528,697 | B2 * | 12/2016 | Sonnervig | F22B 1/00 |
| 2013/0118422 | A1 | 5/2013 | Mandeville | |
| 2015/0033741 | A1 * | 2/2015 | Iwasaki | F01K 7/38 60/657 |
| 2015/0211731 | A1 * | 7/2015 | Young | F22D 5/00 60/692 |
| 2021/0331089 | A1 * | 10/2021 | Silvestrini | B01D 19/0063 |

FOREIGN PATENT DOCUMENTS

| | | |
|---|---|---|
| CN | 106287654 | 1/2017 |
| CN | 106678771 | 5/2017 |
| CN | 110500572 | 11/2019 |
| EP | 0359735 | 3/1990 |
| JP | S57191405 | 11/1982 |
| RU | 2607118 | 1/2017 |
| WO | 96/39594 | 12/1996 |

* cited by examiner

AUXILIARY BOILER SYSTEMS AND METHODS OF OPERATING AND IMPLEMENTING SAME

CROSS REFERENCE TO RELATED APPLICATION

This application claims the benefit of U.S. provisional patent application No. 63/158,617 filed on Mar. 9, 2021 and entitled "Auxiliary Boiler Systems and Methods of Operating and Implementing Same," and incorporates by reference herein the contents of that provisional patent application in their entirety.

FIELD

The present disclosure relates to boiler systems and methods and, more particularly, to auxiliary boiler systems and methods of operating and implementing such auxiliary boiler systems including, for example, those involving industrial water tube boilers.

BACKGROUND

Auxiliary boiler systems are used in power plants to supply steam needed for maintaining the steam turbine seals and to satisfy other needs at times when the main steam sources in the plants are off-line. There are some unique requirements for auxiliary boiler systems. In particular, such systems typically are in a standby condition and operate for a fraction of the time in a year. When such systems are activated, the systems typically start up from cold conditions, but nevertheless rapid warm up/start up and getting to emission compliance at the shortest possible time is generally preferred. Further, simplicity in operation and rugged designs of such systems is generally preferred, and remote start up capabilities are generally expected. In contrast to main boiler systems, thermal efficiency is not a prime driver/primary concern with respect to the design of such auxiliary boiler systems, which are generally intended to be employed merely as stand by equipment. Finally, auxiliary boiler systems generally are designed in manners intended to lessen or minimize the difficulty of assembling or implementing such systems in the field. Often in such systems, all system components are to be skidded and packaged in the factory with a specific requirement being to reduce field installation effort.

Conventional Industrial Water Tube (IWT) package boiler systems are often employed as auxiliary boiler systems in power plants to generate low pressure and low temperature steam. Current practice is to use a standard Package IWT system for this application with all of the components/elements and customize it to skid the components to the maximum extent. Referring to FIG. 1, an example Prior Art auxiliary boiler system 100 of this type includes an auxiliary boiler 102 having a burner/windbox 103, a storage tank, 104, a deaerator (or deaerator tank) 106, which is typically integral with storage tank 104, and a condensate storage tank 108. As illustrated, the condensate storage tank 108 includes a first input port 110 at which the condensate storage tank receives condensate from a condensate water control skid (or station) 112 via a first input pipe 113, and a second input port 114 at which the condensate storage tank receives make-up water (or demin water) from a make-up (or demin) water control skid (or station) 116 via a second input pipe 117. Additionally, the condensate storage tank 108 includes first and second output ports 118 and 120, respectively, by which the condensate storage pipe can output condensate via first and second output pipes 122 and 124, respectively, for receipt at respective input ports of first and second condensate pumps (or pump skids) 126 and 128, respectively, each of which includes a respective centrifugal pump and a respective motor for driving the respective pump.

Further as shown, condensate piping 130 couples each of the first and second condensate pumps 126 and 128 with a first upper end input port 132 of the deaerator 106. The condensate piping includes a first pipe portion 134, a second pipe portion 136, a third pipe portion 138, and a fourth pipe portion 140. The third and fourth pipe portions 138 and 140 are coupled with one another by way of an additional make-up water control skid (or station) 142. The fourth pipe portion 140 is coupled between the make-up water control skid 142 and the deaerator 106, and the third pipe portion 138 is coupled between the make-up water control skid and each of the first pipe portion 134 and second pipe portion 136, which respectively link the third pipe portion 138 with respective output ports of the respective first and second condensate pumps 126 and 128, respectively. By virtue of this arrangement, each of the first and second condensate pumps 126 and 128 operate to pump condensate from the condensate storage tank 108 to the deaerator 106, as governed by the additional make-up water control skid 142.

Further as shown, the deaerator 106 not only includes the first upper end input port 132 at which mixed make-up water can be received, but also includes a second upper end input port 144 and a vent output port 146 also located at or proximate to the upper end of that tank. The vent output port 146 permits gas separated in the deaerator 106 to exit the deaerator, and the second upper end input port 144 allows pegging steam to be communicated to the deaerator from the auxiliary boiler 102 by way of boiler-to-deaerator steam piping 148. More particularly, the boiler-to-deaerator steam piping 148 includes a first pipe portion 150 and a second pipe portion 152 that are coupled with one another by way of a pegging steam control skid (or deaerator steam flow control station) 154. The first pipe portion 150 links the pegging steam control skid 154 with an output port 156 of the auxiliary boiler 102 from which steam can be output, and the second pipe portion 152 links the pegging steam control skid with the second upper end input port 144 of the deaerator 106. By virtue of this arrangement, pegging steam, which is typically at a higher pressure (e.g., operating pressure of the auxiliary boiler 102) than the pressure within the deaerator, is permitted to exit the auxiliary boiler.

The deaerator 106 is supported on the storage tank 104 by a conduit (flange) 158 connecting those structures. Additionally, although not shown in detail, it should be appreciated that each of the condensate storage tank 108 and the storage tank 104 is supported upon a respective tank stand. Also, the bottom end structure 158 of the deaerator 106 includes a conduit 160 so that feedwater can proceed from the deaerator to the storage tank 104. Additionally, the storage tank 104 includes first and second output ports 162 and 164, respectively, by which the storage tank can output feedwater via first and second output pipes 166 and 168, respectively, for receipt at respective input ports of first and second boiler feed (or feedwater) pumps (or pump skids) 170 and 172, respectively, each of which includes a respective centrifugal pump and a respective motor for driving the respective pump.

Further as shown, feedwater piping 174 couples each of the first and second boiler feed pumps 170 and 172 with an economizer 176 that is positioned externally of the auxiliary boiler 102. The feedwater piping 174 includes a first pipe portion 178, a second pipe portion 180, a third pipe portion 182, and a fourth pipe portion 184. The third and fourth pipe portions 182 and 184 are coupled with one another by way of a boiler feedwater control skid (or station) 186. The fourth pipe portion 184 is coupled between the boiler feedwater control skid 186 and a first port 188 of the economizer 176, and the third pipe portion 182 is coupled between the boiler feedwater control skid and each of the first pipe portion 178 and second pipe portion 180, which respectively link the third pipe portion 182 with respective output ports of the respective first and second boiler feed pumps 170 and 172, respectively. By virtue of this arrangement, each of the first and second boiler feed pumps 170 and 172 can operate to pump feedwater from the storage tank 104 (and indirectly from the deaerator 106) to the economizer 176, as governed by the boiler feedwater control signal 186.

The economizer 176, in addition to having the first port 188, additionally includes a second port 190. The second port 190 is coupled by an additional pipe (boiler to economizer piping) 192 with a feedwater input port 194 of the auxiliary boiler 102. When the economizer 176 is functioning, feedwater is routed from the boiler feedwater control skid 186 via the fourth pipe portion 184 to the first port 188 of the economizer, through the economizer, and then from the economizer via the second port 190 and additional pipe 192 to the feedwater input port 194 of the auxiliary boiler 102.

However, in an alternate manner of operation made possible by way of a bypass pipe 196 linking the fourth pipe portion 184 with the additional pipe 192, and additionally by way of first, second, and third control valves 197, feedwater can instead be routed to proceed from the boiler feedwater control skid 186 to the auxiliary boiler 102 without passing through the economizer 176. As shown, the three control valves 197 are particularly positioned along the bypass pipe 196, between the junction of the bypass pipe with the fourth pipe portion 184 and the first port 188 of the economizer 176, and between the junction of the bypass pipe with the additional pipe 192 and the second port 190 of the economizer. It will be appreciated that feedwater flows through the economizer 176 when the one of the control valves 197 along the bypass pipe 196 is closed but the other two of the control valves are open, but alternatively that feedwater bypasses the economizer when the one of the control valves along the bypass pipe 196 is open but the other two of the control valves are closed.

In view of the above arrangement, the auxiliary boiler 102 receives feedwater from the deaerator 106 via the storage tank 104, and the deaerator receives mixed or make-up water from the condensate storage tank 108. Both of the storage tank 104 and the condensate storage tank 108 are set on stands/support structures at higher elevation(s) to ensure that the pumps (the pumps 126, 128, 170, and 172) will operate properly without cavitation—the height of each stand depends on pump outlet pressure. Additionally, as already discussed, pegging steam emitted from the auxiliary boiler 102 can be provided back to the deaerator 106 via the boiler-to-deaerator steam piping 148. Further as shown, the auxiliary boiler additionally includes a steam output port 198 by which additional steam is communicated out of the auxiliary boiler by way of steam outlet piping 199 that serves as a main steam outlet.

Although conventional auxiliary boiler systems such as that shown in FIG. 1 are suitable for achieving many of the purposes and goals of such systems, such conventional systems have certain disadvantages. In particular, such conventional auxiliary boiler systems are still quite complicated, do not sufficiently satisfy a need for a less complex system, add cost to the manufacturer, and do not sufficiently reduce the effort, time, and cost required in the field to install and operate the system. FIG. 2 provides a flow chart 200 showing example steps of a conventional (Prior Art or current) auxiliary boiler system installation process suitable for implementation of the auxiliary boiler system 100 of FIG. 1, and provides an illustration of the significant complexity associated with the installation of such conventional auxiliary boiler systems. As shown, installation of such a conventional auxiliary boiler system according to this process can be viewed as including first, second, and third branches of steps 202, 220, and 240 relating to installation of the condensate tank-related structures, deaerator storage tank-related structures, and auxiliary boiler-related structures (including the economizer), respectively. In general, the steps of each of the first, second, and third branches 202, 220, and 240 can be performed at the same or substantially the same times, or alternatively can be performed sequentially, or partly sequentially and partly at the same time.

More particularly, the first branch of steps 202 includes a first step 204 at which a condensate tank support structure or stand (not shown) is set, followed by a second step 206 at which the condensate storage tank 108 is set, and then further followed by a third step 208 at which the condensate (or tank) pumps (or pump skids), such as the pumps 126 and 128 is or are set. Additionally, following the third step 208 is a fourth step 210 including first, second, and third substeps 212, 214, and 216, respectively (which can be performed substantially simultaneously or in parallel as illustrated, or alternatively sequentially). The make-up (or demin) water control (or water control feed) skid (or station) 116 is installed at the first substep 212, the condensate water control (or water feed control) skid (or station) 112 is installed at the second substep 214. Further, at the third substep 216, the input pipes (interconnecting piping) 113 and 117 respectively are installed between the respective skids (or valve skids) 116 and 112 and the condensate storage tank ports 114 and 110, respectively, and additionally the output pipes (additional interconnecting piping) 122 and 124 respectively are installed between the respective condensate storage tank ports 118 and 120 and the respective condensate pumps (or condensate tank feedwater pumps or pump skids) 126 and 128.

The second branch of steps 220 includes a fifth step 222 at which the deaerator tank support structure (or stand) is set, followed by a sixth step 224 at which the deaerator storage tank is set, and then further followed by a seventh step 226 at which a deaerator heater section is set. More particularly, the fifth step 222, sixth step 224, and seventh step 226 should respectively be understood as referring to the setting of the tank support structure (or stand) for the storage tank 104 of FIG. 1, the setting of the storage tank 104, and the setting of the deaerator 106 atop the storage tank 104. The seventh step 226 in turn is followed by an eighth step 228 at which a deaerator feedwater pump skid is set—more particularly the eighth step 228 can be understood to refer to the setting of the boiler feed pumps (e.g., the pumps 170 and 172 of FIG. 1). Additionally, following the eighth step 228 is a ninth step 230 including fourth, fifth, and sixth substeps 232, 234, and 236, respectively (which can be performed substantially simultaneously or in parallel as illustrated, or alternatively sequentially). A pegging steam PRV (pressure reducing valve) valve skid such as the pegging steam control skid 154 is installed at the fourth substep 232, a combined make-up water control skid such as the additional make-up water control skid 142 is installed at the fifth substep 234, and interconnecting piping from those valve skids to the deaerator tank and the feedwater pumps is installed at the sixth substep 236.

As for the third branch of steps 240, this branch of steps includes a tenth step 242 at which the auxiliary boiler (or auxiliary boiler pressure vessel) 102 is set, followed by an eleventh step 244 at which the economizer 176 and economizer support structure (if included) are set. The eleventh step 244 is then further followed by a twelfth step 246 at which the boiler feedwater control skid (or station) 186 is set, followed by a thirteenth step 248 at which interconnecting piping (e.g., the pipe portion 184, and pipes 192 and 196) from the boiler feedwater control skid (or station) to the boiler and duct work is installed. Finally, upon the completion of all of the steps (and substeps) of the first, second, and third branches of steps 202, 220, and 240, the auxiliary boiler system installation process is completed at a final step 238, at which remaining interconnecting piping is installed so as to complete the assembly (or coupling) of the condensate tank-related structures assembled by way of the first branch of steps, deaerator tank-related structures assembled by way of the second branch of steps, and auxiliary boiler-related structures assembled by way of the third branch of steps so as to form the overall auxiliary boiler system (the final step 238 can also be considered to be a final step of any one or more of the first, second, and third branches of steps).

Based upon the above description concerning FIG. 2, it should be further appreciated that the assembly and implementation of such conventional auxiliary boiler systems in the above-described manner is complicated, costly, and time-consuming. For at least one or more of these reasons, or one or more other reasons, it would be advantageous if new or improved auxiliary boiler systems, and/or new or improved methods for operating and/or implementing same, could be developed.

SUMMARY

In at least some example embodiments, the present disclosure relates to an auxiliary boiler system for use in conjunction with a main steam source. The auxiliary boiler system includes an auxiliary boiler, a deaerator coupled directly to and integrated with the auxiliary boiler, and a condensate storage tank coupled at least indirectly to the deaerator.

Further, in at least some example embodiments, the present disclosure relates to a method of implementing an auxiliary boiler system for use in conjunction with a main steam source. The method includes setting a condensate storage tank in relation to a first support structure at a first position, and setting an auxiliary boiler at a second position. The method additionally includes directly coupling a deaerator to the auxiliary boiler so that the deaerator is integrated with the auxiliary boiler, and installing at least one interconnection by which the condensate storage tank is at least indirectly coupled to the deaerator.

Additionally, in at least some example embodiments, the present disclosure relates to a method of operating an auxiliary boiler system. The method includes providing a deaerator coupled directly to and integrated with the auxiliary boiler, and a condensate storage tank coupled at least indirectly to the deaerator, and causing feedwater from the condensate storage tank to flow directly or substantially directly to the deaerator, where an amount of the feedwater received at the deaerator is controlled at least in part by way of a boiler feedwater control skid fluidly coupled between the condensate storage tank and the deaerator. The method also includes, after being deaerated by the deaerator, communicating the feedwater from the deaerator to the auxiliary boiler by way of a first conduit.

BRIEF DESCRIPTION OF THE DRAWINGS

Specific examples have been chosen for purposes of illustration and description, and are shown in the accompanying drawings, forming a part of the specification.

DETAILED DESCRIPTION

The present inventors have recognized the limitations of conventional auxiliary boiler systems such as those discussed above, and that the standby nature of auxiliary boiler systems and the need for less complex auxiliary boiler systems present challenges that conventional auxiliary boiler system designs do not address. With such considerations in mind, the present inventors have recognized that improved auxiliary boiler systems with distinctive packaging arrangements can avoid or experience to a lesser degree one or more of these or other limitations (or achieve one or more advantages by comparison with conventional auxiliary boiler systems). An auxiliary boiler system having such an arrangement can be advantageous both in terms of reducing the overall complexity of the auxiliary boiler system relative to conventional auxiliary boiler systems and also in terms of reducing the field installation work, reducing the total installed and operating cost of the system for the end user, and reducing the total cost of ownership for the end user/customer. In at least some such embodiments, the auxiliary boiler system employs an Industrial Water Tube package boiler and the overall system can be referred to as an Auxiliary Package IWT Boiler that is Optimized For Construction (OFC).

More particularly, in at least some embodiments encompassed herein, an improved auxiliary boiler system is configured to employ, and achieves reduced complexity at least in part by employing, a deaerator that is integrated into the boiler package. Further, in at least some such embodiments, the improved auxiliary boiler system employs a condensate storage tank that is repurposed as a feedwater storage tank. By way of such an arrangement, the condensate storage tank (which receives condensate and/or make-up water) is coupled directly, or substantially directly, with the deaerator. Such direct, or substantially direct, coupling of the condensate storage tank with the deaerator in some example embodiments can involve only, for example, condensate pump and boiler feedwater control skid components and, in some such embodiments, additionally a condensate heater (and possibly associated bypass or valve components), being positioned along the flow path between the condensate storage tank and the deaerator.

Additionally in some such embodiments, pegging steam and make-up water control skids (water control stations and associated piping) need not be present in the auxiliary boiler system even though such features are present in conventional embodiments such as that discussed above with respect to FIG. 1 (e.g., the pegging steam control skid 154 and the make-up water control skid 142). Also, elaborate deaerator-to-boiler feedwater piping allowing for the indirect coupling of a deaerator/deaerator storage tank (e.g., piping such as the feedwater piping 174 of FIG. 1) need not be present in the improved auxiliary boiler system, as the deaerator is directly coupled to the auxiliary boiler.

Figure 1:
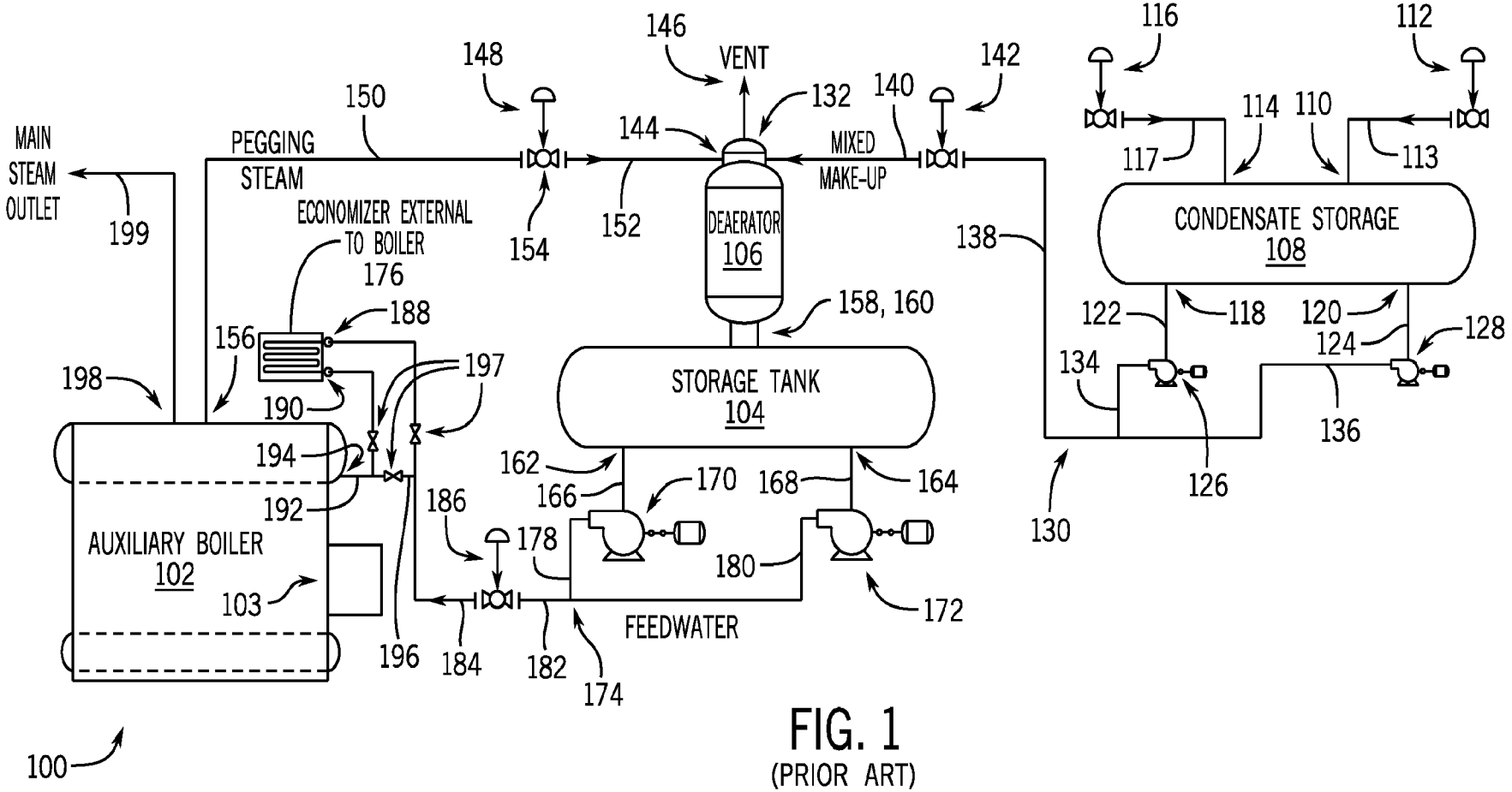
FIG. 1 (PRIOR ART)
FIG. 1 is a schematic representation of a conventional (Prior Art) auxiliary boiler system.
Figure 2:
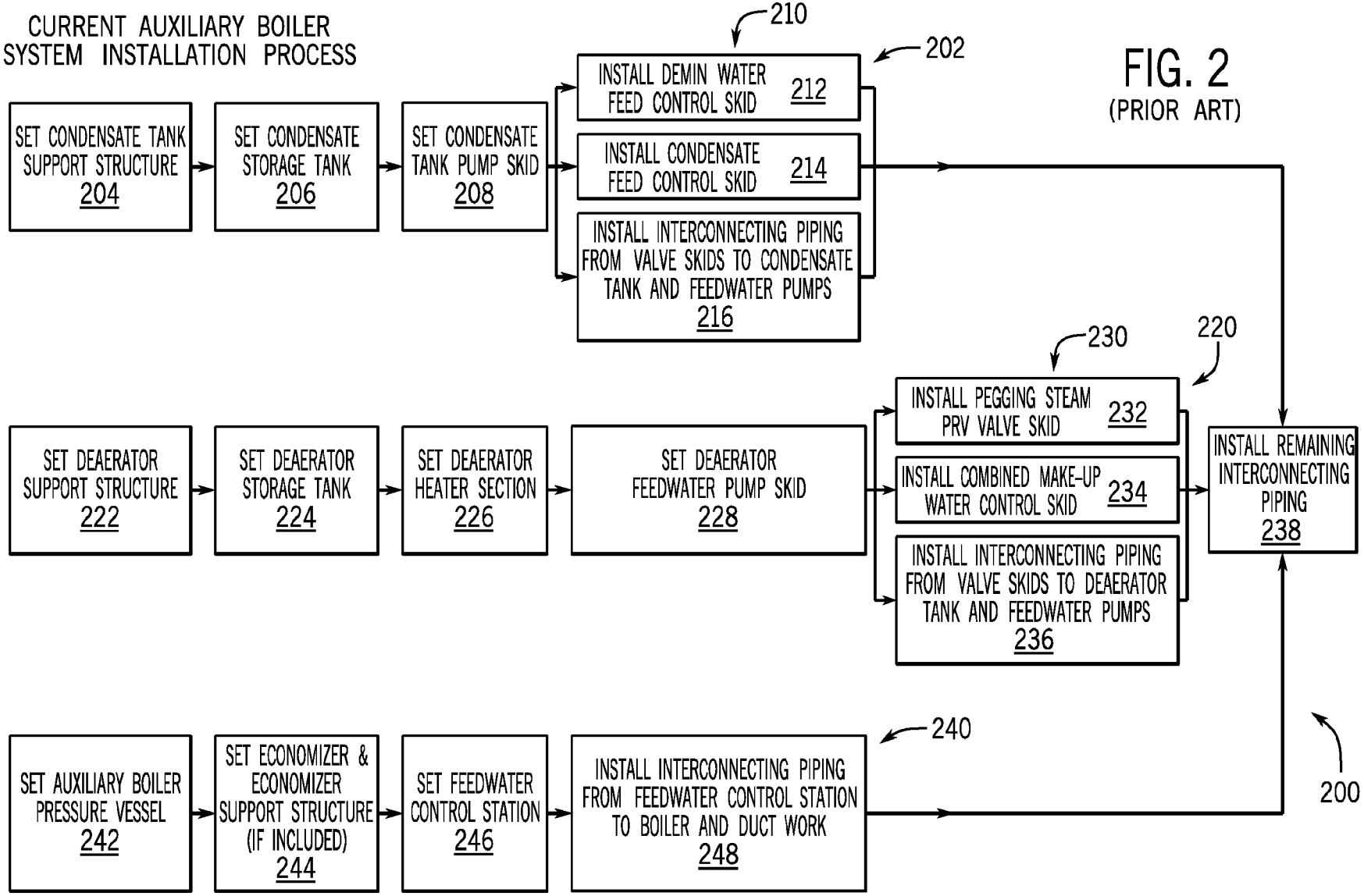
FIG. 2 (PRIOR ART)
FIG. 2 is a flow chart showing example steps of a conventional (Prior Art) auxiliary boiler system installation process, such as is applicable in relation to the auxiliary boiler system of FIG. 1.

Additionally, in some such embodiments encompassed herein, the improved auxiliary boiler system employs only the condensate storage tank (in addition to an auxiliary boiler) instead of employing both of the storage tank (deaerator storage tank) 104 and condensate storage tank 108 included by conventional auxiliary boiler systems such as the conventional auxiliary boiler system 100 of FIG. 1. Correspondingly, by comparison with conventional auxiliary boiler systems, such an improved auxiliary boiler system employs one less tank and at least one less associated support structure or stand, namely, that of the deaerator storage tank, than that such conventional auxiliary boiler systems. Further by comparison with conventional embodiments that employ both a condensate storage tank and a deaerator (or feedwater) storage tank, such an improved auxiliary boiler system avoids the inclusion of the associated level control and pressure relief equipment necessary for implementing such conventional embodiments (e.g., the improved auxiliary boiler system avoids the inclusion of level control instrumentation and pressure relief valves such as those employed on the storage tank 104 of FIG. 1, or condensate transfer pumps and controls). Among other things, no boiler-to-deaerator steam piping or deaerator steam flow control skid or station (e.g., corresponding to the boiler-to-deaerator steam piping 148 and pegging steam control skid 154) are employed. Also, no condensate pumps (or pump skids, e.g., corresponding to the pumps 126 and 128 of FIG. 1) or make-up water control skid or station (e.g., corresponding to the additional make-up water control skid 142 of FIG. 1) need be employed. Therefore, such an improved auxiliary boiler system entails less system complexity and controls by contrast to conventional auxiliary boiler systems such as that of FIG. 1.

Further, in accordance with at least some embodiments encompassed herein, the improved auxiliary boiler system includes a condensate heater that is integrated into the boiler package, particularly integral within the auxiliary boiler so as to improve boiler efficiency if required with minimal impact to installation costs. Such implementation of the condensate heater can serve to recover thermal efficiency associated with operation of the auxiliary boiler system, and can be of particular significance if thermal efficiency is a critical parameter for the plant of which the auxiliary boiler system forms a part. At the same time, the implementation/presence or use of such a condensate heater can be considered an optional feature that, although present and utilized in some embodiments of improved auxiliary boiler systems encompass herein, need not be present or need not be utilized in other embodiments of improved auxiliary boiler systems encompassed herein. Further, in some embodiments of improved auxiliary boiler systems encompassed herein, the steam drum water holding capacity (e.g., within the auxiliary boiler) can be oversized to establish steaming before needing feedwater during cold starts.

Figure 3:
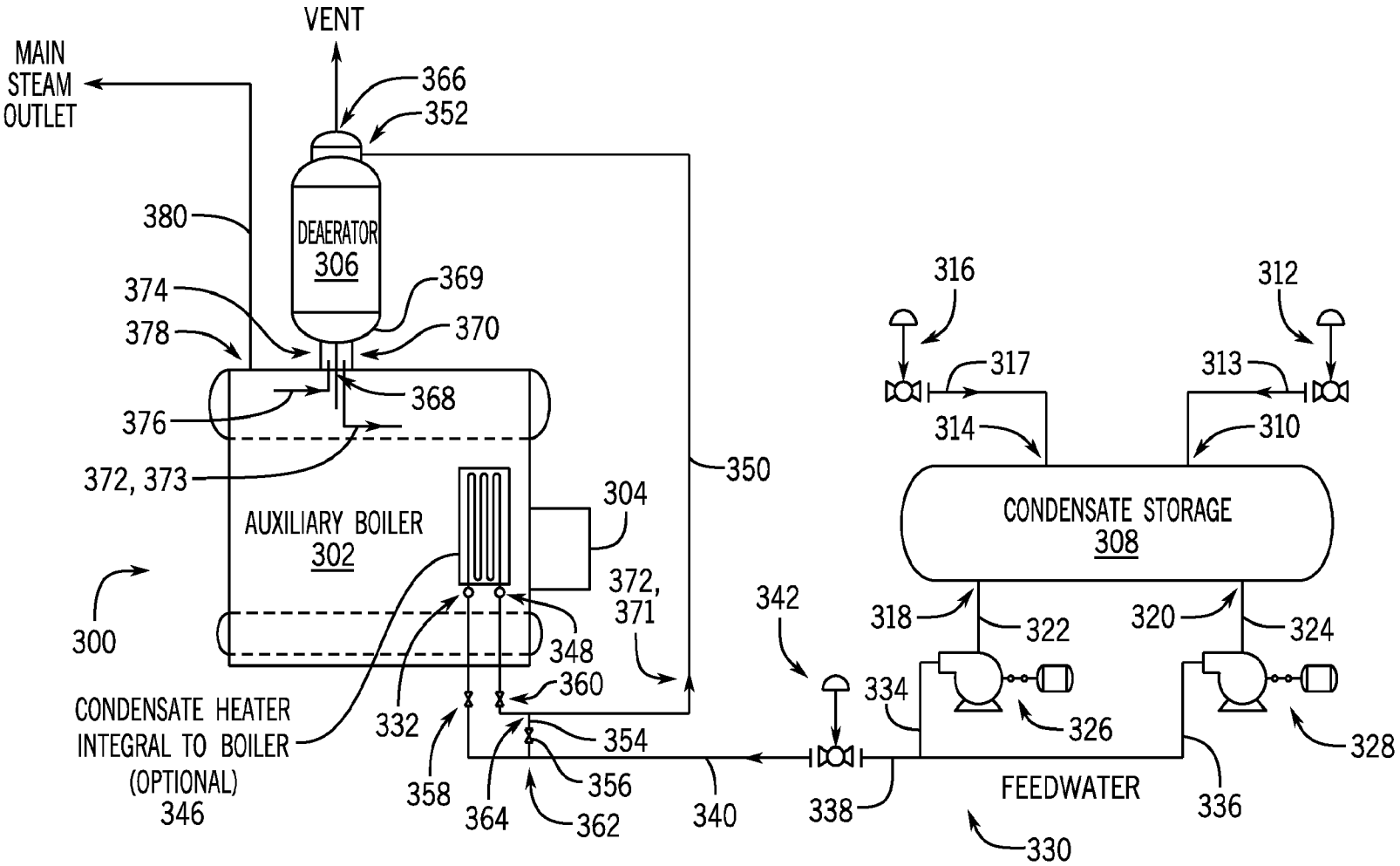
FIG. 3 is a schematic representation of an improved auxiliary boiler system in accordance with an example embodiment encompassed herein.

Referring to FIG. 3, an improved auxiliary boiler system 300 in accordance with one example embodiment encompassed herein includes an auxiliary boiler 302 having a burner/windbox 304, a deaerator (or deaerator tank) 306, and a condensate storage tank 308. As illustrated, the condensate storage tank 308 includes a first input port 310 at which the condensate storage tank receives condensate from a condensate water control skid (or station) 312 via a first input pipe 313, and a second input port 314 at which the condensate storage tank receives make-up water (or demin water) from a make-up (or demin) water control skid (or station) 316 via a second input pipe 317. Additionally, the condensate storage tank 308 includes first and second output ports 318 and 320, respectively, by which the condensate storage tank can output feedwater (which also may be considered condensate) 372 via first and second output pipes 322 and 324, respectively. The first and second output pipes 322 and 324 respectively are coupled to respective input ports of first and second condensate pumps (or pump skids) 326 and 328, respectively, each of which includes a respective centrifugal pump and a respective motor for driving the respective pump, such that the feedwater 372 output from the condensate storage tank 308 is received by the condensate pumps 326, 328.

Further as shown, in the present embodiment, a condensate heater 346 is provided within, and integral to, the auxiliary boiler 302. Additionally, condensate piping 330 couples each of the first and second condensate pumps 326 and 328 with an input port 332 of the condensate heater 346. The condensate piping 330 includes a first pipe portion 334, a second pipe portion 336, a third pipe portion 338, and a fourth pipe portion 340. The third and fourth pipe portions 338 and 340 are coupled with one another by way of a boiler feedwater control skid (or boiler feedwater control station) 342. The fourth pipe portion 340 is coupled between the feedwater control skid 342 and the input port 332 of the condensate heater 346, and the third pipe portion 338 is coupled between the feedwater control skid and each of the first pipe portion 334 and second pipe portion 336, which respectively link the third pipe portion 338 with respective output ports of the respective first and second condensate pumps 326 and 328, respectively. By virtue of this arrangement, each of the first and second condensate pumps 326 and 328 operates to pump the feedwater 372 from the condensate storage tank 308 to the condensate heater 346, as governed by the boiler feedwater control skid 342.

The condensate heater 346, in addition to having the input port 332, additionally includes an output port 348. The output port 348 is coupled by an additional pipe 350 with a deaerator input port 352 of the deaerator 306. When the condensate heater 346 is functioning, typically the feedwater 372 is routed from the boiler feedwater control skid 342 via the fourth pipe portion 340 to the input port 332 of the condensate heater 346, through the condensate heater at which the feedwater is heated (within the auxiliary boiler 302). Additionally, the feedwater (or condensate) 372, after being heated, is then routed from the condensate heater via the output port 348 and additional pipe 350 to the deaerator input port 352 of the deaerator 306. Given that the feedwater 372 routed in this manner has not yet passed through the deaerator 306, it can be considered un-deaerated feedwater (or condensate) 371 (as represented by an arrowhead along the additional pipe 350).

However, in the present embodiment, an alternate manner of operation is also made possible by way of a bypass pipe 354 linking the fourth pipe portion 340 with the additional pipe 350, and additionally by way of first, second, and third control valves 356, 358, and 360, respectively. In this alternate manner of operation, the feedwater (or condensate) 372 (which again at this point is the un-deaerated feedwater 371) can instead be routed to proceed from the boiler feedwater control skid 342 to the deaerator input port 352 of the deaerator 306 without passing through the condensate heater 346. As shown, the first control valve 356 is particularly positioned along the bypass pipe 354, between a first junction 362 of the bypass pipe with the fourth pipe portion 340 and a second junction 364 of the bypass pipe with the additional pipe 350. Additionally, the second control valve 358 is positioned along the fourth pipe portion 340 between the first junction 362 and the input port 332 of the condensate heater 346, and the third control valve 360 is positioned along the additional pipe 350 between the second junction 364 and the output port 348 of the condensate heater 346.

Given this arrangement, it will be appreciated that, when the first control valve 356 along the bypass pipe 354 is closed but the second and third control valves 358 and 360 respectively are open, then the feedwater 372 flows from the boiler feedwater control skid 342 through the condensate heater 346 to the input port 352 of the deaerator 306. As the feedwater 372 does not collect within the condensate heater 346 to any meaningful extent, the magnitude of the flow of the feedwater 372 into the input port 332 of the condensate heater 346 from the boiler feedwater control skid (via the fourth pipe portion 340) is equal to the magnitude of the flow of the feedwater 372 out of the output port 348 of the condensate heater 346 and to the input port 352 of the deaerator 306 (via the additional pipe 350). Alternatively, when the first control valve 356 along the bypass pipe 354 is open but the second and third control valves 358 and 360 are closed, then the feedwater 372 proceeds from the boiler feedwater control skid 342 to the input port 352 of the deaerator 306 directly without passing through (or being heated at) the condensate heater 346. In this case, flow of the feedwater 372 occurs by way of the bypass pipe 354, the segment of the fourth pipe portion 340 between the boiler feedwater control skid 342 and the first junction 362, and the segment of the additional pipe 350 between the second junction 364 and the input port 352.

As mentioned above, in the present embodiment the deaerator 306 is integrated with the auxiliary boiler 302. More particularly as shown in FIG. 3, the deaerator 306 is supported, at a bottom end structure 368 thereof, atop a steam drum of the auxiliary boiler 302. The auxiliary boiler 302 in turn sits directly on the ground—that is, no tank stand or support structure is employed to support the auxiliary boiler. In contrast, the condensate storage tank 308 is supported upon a tank stand or support structure (not shown) relative to the ground. The tank stand or support structure for the condensate storage tank 308 can be of sufficient height so as to assist with proper functioning of the condensate pumps 326, 328 in view of the height(s) of those pumps (the respective heights can be set taking into account pump outlet pressure). In the present example embodiment, the bottom end structure 368 of the deaerator 306 includes a short (relative, for example, to the height of the deaerator 306) tubular structure that directly couples (or directly connects) the deaerator to a top (or upper) surface of the auxiliary boiler 302. Accordingly, the deaerator 306 is physically supported upon the auxiliary boiler 302, by way of the bottom end structure 368 (as well as possibly by one or more other connective support structures, such as struts shown in FIG. 4). Due to this direct coupling of the deaerator 306 to the auxiliary boiler 302, the deaerator is not only physically supported by, but also can be considered integral with, the auxiliary boiler.

In the present embodiment, the bottom end structure 368 of the deaerator 306 more particularly includes a connecting flange/nozzle that allows for the deaerator 306 and the auxiliary boiler 302 to be integral. The connecting flange/nozzle is configured to allow two types of fluid flow between the deaerator 306 and the auxiliary boiler 302, so as to fluidly couple both the steam and the water side. More particularly, the connecting flange/nozzle of the bottom end structure 368 includes one nozzle portioned with a splitter plate for steam and water flow on either side. Given this design, the bottom end structure 368 can be understood to include effectively both a first conduit 370 and a second conduit 374 as illustrated in FIG. 3.

Further as shown in FIG. 3, the first conduit 370 particularly extends between the deaerator 306 and the auxiliary boiler 302 so that the feedwater 372 can proceed from the deaerator to the auxiliary boiler. In contrast to the feedwater received by the deaerator 306, which as discussed above is the un-deaerated feedwater (or condensate) 371, the feedwater 372 output from the deaerator 306 via the first conduit 370 is deaerated feedwater 373. Additionally as shown, the second conduit 374 also extends between the deaerator 306 and the auxiliary boiler 302. The second conduit 374 particularly allows for pegging steam 376 to proceed from the auxiliary boiler 302 to the deaerator 306. In the present embodiment, the inlet and outlet terminal points for the steam and feedwater will be different elevations—that is, the first conduit 370 begins and ends at different vertical positions (relative to ground) than the second conduit 374, so as to facilitate the proper flow of steam and feedwater.

Although in the present embodiment the bottom end structure 368 of the deaerator 306 is a short, tubular structure as mentioned above, in alternate embodiments the bottom end structure can take other forms. For example, although the bottom end structure 368 of the deaerator 306 in the present embodiment is shown to have a length so that a bottom rim 369 of the deaerator 306 is not in contact with an upper surface of the auxiliary boiler 302, in other embodiments the bottom rim of the deaerator 306 can rest upon or even be integrally formed with the upper surface of the auxiliary boiler 302. In such embodiments, the bottom end structure 368 can simply be considered to be that bottom rim of the deaerator (deaerator tank) or the junction of the deaerator with the auxiliary boiler, including a pair of orifices formed within that junction between deaerator and the auxiliary boiler by which flow of the deaerated feedwater 373 and the pegging steam 376 can occur.

Further as shown, the deaerator 306 not only includes the deaerator input port 352 at which the un-deaerated feedwater (or condensate) 371 can be received, but also includes a vent output port 366 also located at or proximate to the upper end of that tank. The vent output port 366 permits gas separated (e.g., separated from the condensate/feedwater) in the deaerator 306 to exit the deaerator. Additionally, portions of the pegging steam 376 that enter the deaerator 306 by way of the second conduit 374 also can exit the deaerator by way of the vent output port 366. Further as shown, the auxiliary boiler 302 also includes a steam output port 378 by which additional steam is communicated out of the auxiliary boiler by way of steam outlet piping 380 that serves as a main steam outlet.

Figure 4:
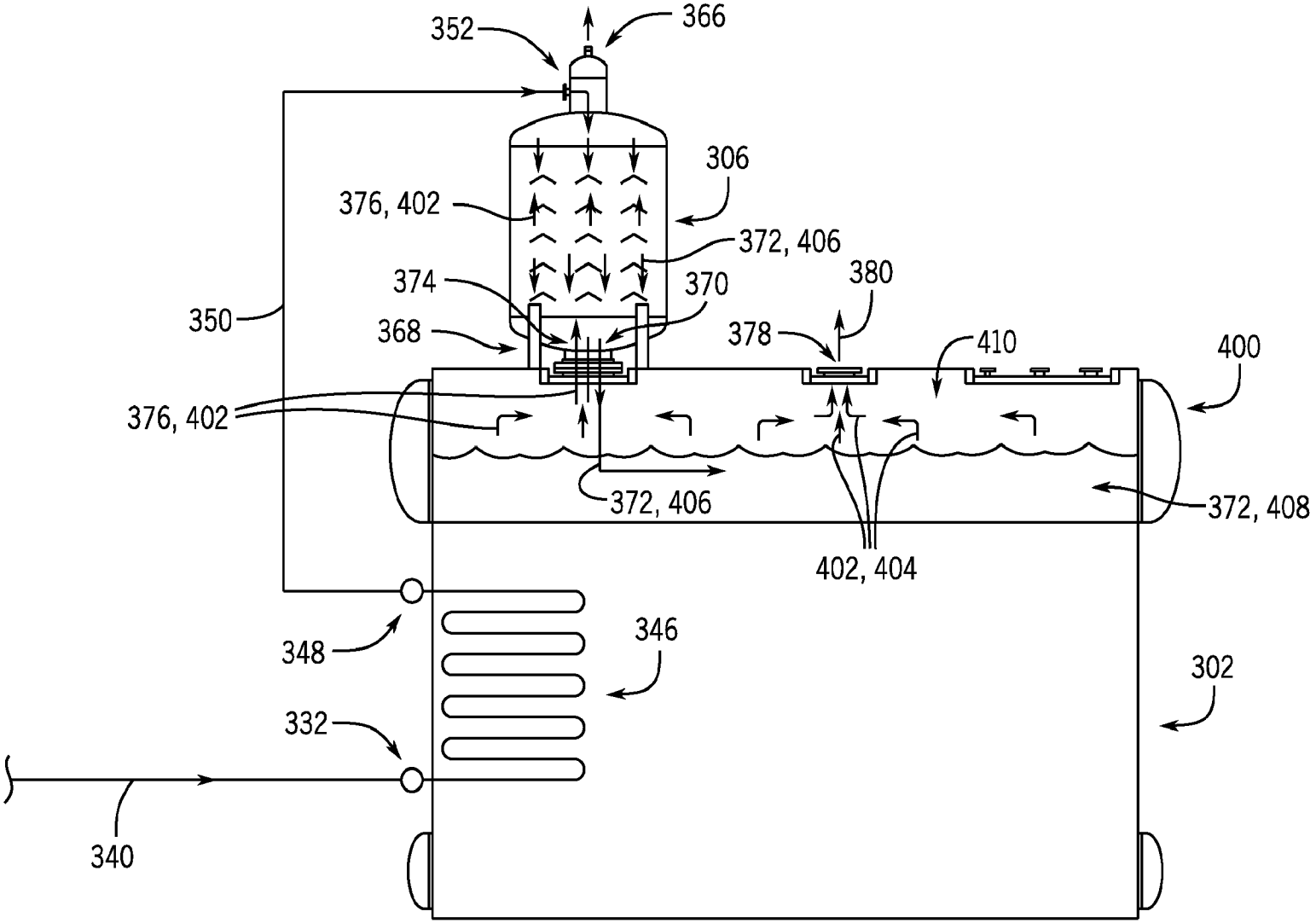
FIG. 4 is a schematic representation of portions of the auxiliary boiler system of FIG. 3, highlighting certain aspects of the operation of that system and showing a condensate heater of that system as being integral to the auxiliary boiler of that system.

Referring additionally to FIG. 4, features of the improved auxiliary boiler system 300 of FIG. 3, and particularly with respect to operation of the auxiliary boiler 302 and deaerator 306 of that boiler system, are shown in further detail. FIG. 4 again shows that the deaerator 306 is supported upon and integrated with the auxiliary boiler 302, and also that the condensate heater 346 is situated within (and integrally formed with) the auxiliary boiler 302. Also, FIG. 4 again shows that the fourth pipe portion 340 (shown in cutaway) is coupled to the input port 332 of the condensate heater 346 so that the feedwater 372 (the un-deaerated feedwater 371) can be delivered to the condensate heater. Further, FIG. 4 again shows that the output port 348 of the condensate heater 346 is coupled to the deaerator input port 352 of the deaerator 306 so as to allow for the feedwater 372 (again, the un-deaerated feedwater or condensate 371), after being heated, to flow from the condensate heater to the deaerator. Further, FIG. 4 shows that the deaerator 306 is coupled to the auxiliary boiler 302 by way of the bottom end structure 368 of the deaerator, also includes the vent port 366, and that the auxiliary boiler further includes the steam outlet port 378 at which steam can be output from the auxiliary boiler via the steam outlet piping 380 (leading to or serving as the main steam outlet).

It should be appreciated that, although FIG. 4 is intended to represent features of the same improved auxiliary boiler system 300 as is shown in FIG. 3, these representations are schematic in nature. Therefore, although the relative positioning of the condensate heater 346 within the auxiliary boiler 302 is different in FIG. 4 by comparison with the relative positioning of those structures in FIG. 3, and although the positioning of the deaerator 306 relative to the upper surface of the auxiliary boiler 302 is different in FIG. 4 by comparison with the relative positioning of those structures in FIG. 3, nevertheless FIG. 3 and FIG. 4 are intended to be representative of features of the same improved auxiliary boiler system 300. Likewise, although FIG. 4 provides more detail regarding the bottom end structure 368 allowing for the deaerator 306 to be supported upon the auxiliary boiler 302, again nevertheless it is intended that FIG. 3 and FIG. 4 are both representative of the same structure coupling the deaerator tank with the auxiliary boiler 302.

FIG. 4 particularly illustrates in more detail the flow of the feedwater 372 as well as the flow of steam 402, including the pegging steam 376 and additional steam 404, in relation to the deaerator 306 and a steam drum (or auxiliary boiler tank) 400 of the auxiliary boiler 302. As illustrated, first amounts 406 of the feedwater 372 (represented by generally-downwardly-directed arrows) enter the deaerator 306 at the deaerator input port 352 as the un-deaerated feedwater 371 and pass downward through and out of the deaerator and into the steam drum 400, as the deaerated feedwater 373. It should be understood that the first amounts 406 of the feedwater 372 particularly pass into the steam drum 400 (as the deaerated feedwater 373) from the deaerator 306 by way of the first conduit 370 extending through the bottom end structure 368 (again also see FIG. 3). Upon the first amounts 406 of the feedwater 372 reaching the steam drum 400, the first amounts supplement other amounts 408 of the feedwater that are already present in the steam drum.

Additionally as illustrated, the steam 402 arises from heating of the feedwater 372 within the auxiliary boiler 302, particularly the other amounts 408 of the feedwater within the steam drum 400, and passes into and generally upwardly within an upper region 410 within the steam drum, above the other amounts 408 of the feedwater. As represented by generally-upwardly-directed arrows, some portions of the steam 402 constituting the pegging steam 376 pass upwardly from the upper region 410 of the steam drum 400, through the second conduit 374 (see FIG. 3) of the bottom end structure 368 into the deaerator 306, and then upwardly through the deaerator 306 and out through the vent output port 366. Also as represented by other generally-upwardly-directed arrows, other portions of the steam 402 constituting the additional steam 404 pass upwardly from the upper region 410 of the steam drum 400, through the steam output port 378 and into the steam outlet piping 380 serving as the main steam outlet for the auxiliary boiler 302.

Figure 5:
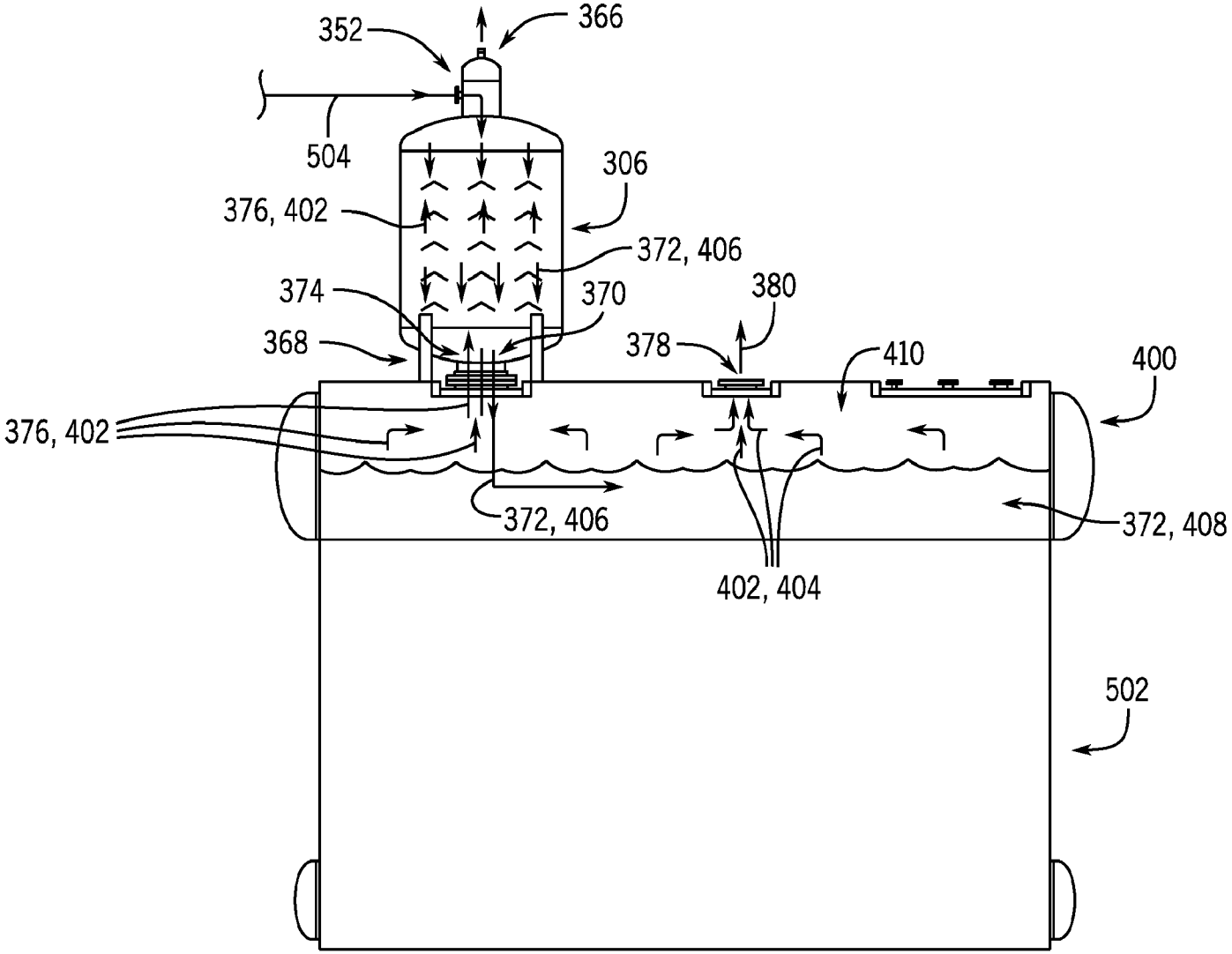
FIG. 5 is a schematic representation of portions of an alternate embodiment of an auxiliary boiler system encompassed herein that differs from that of FIG. 3, which also as in FIG. 4 highlights certain aspects of the operation of that system.

Referring additionally to FIG. 5, features of a modified version of the improved auxiliary boiler system also encompassed by the present disclosure (differing from the improved auxiliary boiler system 300 of FIG. 3) are shown. As with FIG. 4, the features that are shown in FIG. 5 primarily concern the deaerator 306 and an auxiliary boiler of the improved auxiliary boiler system, which in this embodiment is shown to be an auxiliary boiler 502 (rather than the auxiliary boiler 302). In the embodiment of FIG. 5, the auxiliary boiler system includes all of the features of the auxiliary boiler system 300 of FIG. 3 and FIG. 4 except insofar as the auxiliary boiler 502 does not include any condensate heater (e.g., the condensate heater 346 of FIG. 3 and FIG. 4 is missing from FIG. 5) or associated piping. That is, the feedwater 372 (or condensate or make-up water) is supplied directly from the boiler feedwater control skid 342 to the deaerator input port 352 of the deaerator 306 by way of a pipe portion 504, and piping associated with implementation of the condensate heater in the embodiment of FIG. 3 and FIG. 4 (e.g., the fourth pipe portion 340, the additional pipe 350, the bypass pipe 354, and the valves 356, 358, and 360) is not present.

Correspondingly, aside from the absence of the condensate heater 346 and associated piping, the improved auxiliary boiler system of FIG. 5 includes structures that are identical to those described above in regard to FIG. 3 and FIG. 4. That is, although not shown in FIG. 5, it should be recognized that the improved auxiliary boiler system of FIG. 5 again includes each of the condensate storage tank 308, condensate and make-up water control skids 312 and 316, condensate pumps 326 and 328, boiler feedwater control skid 342, and associated piping (e.g., the pipes 313, 317, 322 and 324 and pipe portions 334, 336, and 338). Also, it should further be recognized that the improved auxiliary boiler system of FIG. 5 again includes the steam drum 400 with the steam output port 378 coupled to the steam outlet piping 380, the deaerator 306 with the vent output port 366, and the bottom end structure 368 (including the conduits 370 and 374), and experiences the same types of movements of the feedwater 372 and steam 402 as described in regard to FIG. 3 and FIG. 4.

Accordingly, the modified version of the improved auxiliary boiler system employing the features of FIG. 5 operates in the same manner as the improved auxiliary boiler system 300 of FIG. 3 and FIG. 4 except insofar as the condensate/feedwater/make-up water provided to the deaerator 306 is not heated by any condensate heater, but rather is provided directly from the feedwater control skid 342. The manner in which the first amounts 406 of the feedwater 372 proceed through the deaerator 306 and into the steam drum 400 so as to join the other amounts 408 of the feedwater, and the manner in which the steam 402 exits the steam drum, either as the pegging steam 376 or the additional steam 404, are identical to the corresponding manners of operation described in regard to FIG. 4. It should further be appreciated that the manner in which the feedwater 372 (as the un-deaerated feedwater 371) is communicated from the boiler feedwater control skid 342 (see FIG. 3) by way of the pipe portion 504 to the deaerator input port 352 is functionally identical to the manner in which the feedwater 372 is communicated from the boiler feedwater control skid to the deaerator input port in the embodiment of FIG. 3 and FIG. 4 when the control valves 356, 358, and 360 are actuated so as to cause the feedwater to pass through the bypass pipe 354 rather than through the condensate heater 346.

Figure 6:
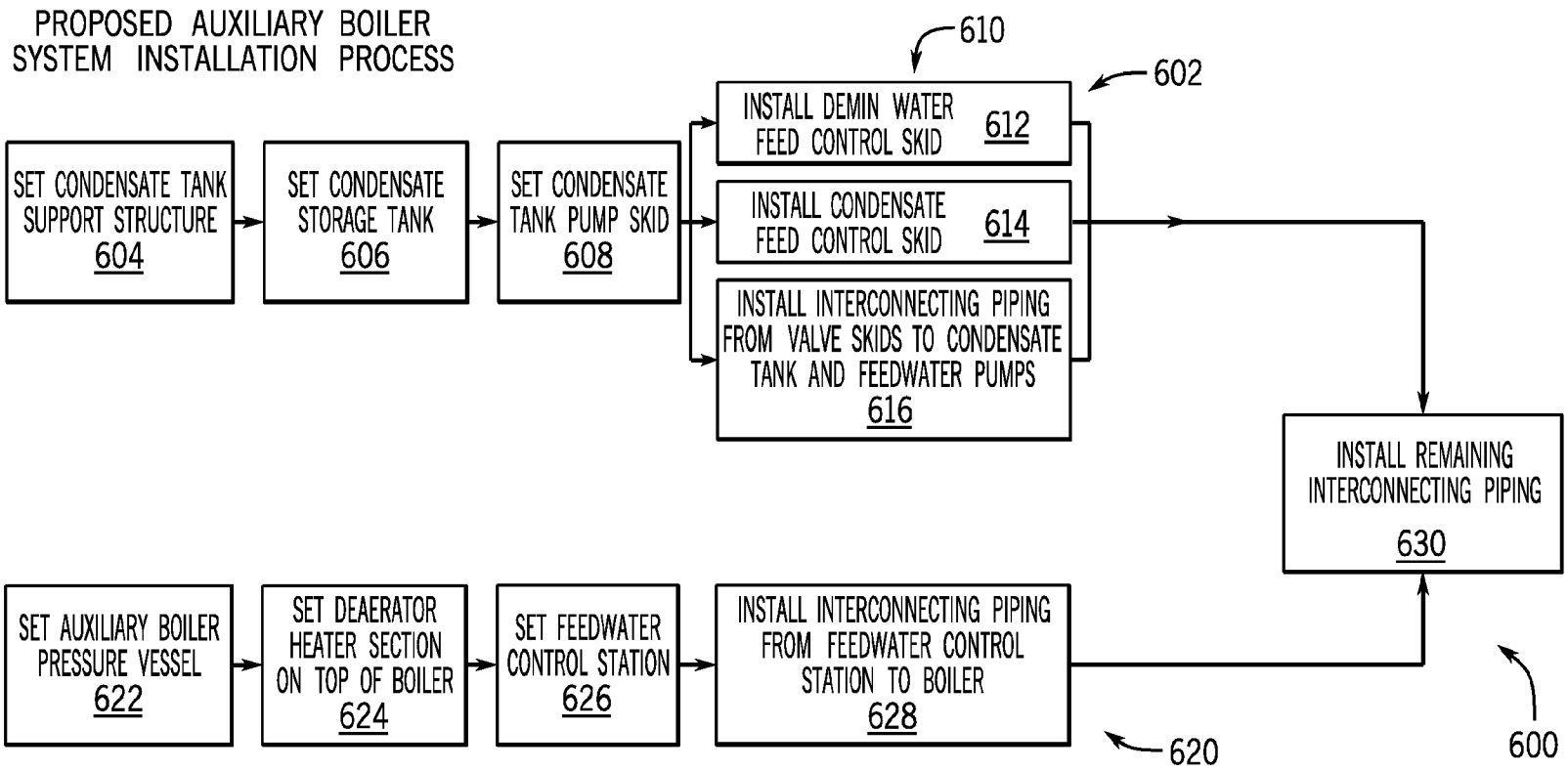
FIG. 6 is a flow chart showing example steps of an auxiliary boiler system installation process in accordance with an example embodiment encompassed herein, which is applicable in relation to the auxiliary boiler system of FIG. 3.

Turning to FIG. 6, a flow chart 600 is provided that shows example steps of an installation process suitable for installing/implementing the improved auxiliary boiler system 300 of FIG. 3 and FIG. 4. As shown, installation of the improved auxiliary boiler system 300 according to this process can be viewed as including first and second branches of steps 602 and 620 relating to installation of the condensate tank-related structures and auxiliary boiler-related structures including the deaerator 306, respectively. In general, the steps of each of the first and second branches 602 and 620 can be performed at the same or substantially the same times, or alternatively can be performed sequentially, or partly sequentially and partly at the same time.

More particularly, the first branch of steps 602 includes a first step 604 at which the condensate tank support structure or stand (not shown in FIG. 3) is set at a first position, followed by a second step 606 at which the condensate storage tank 308 is set in relation to (e.g., upon) the condensate tank support structure. Additionally the second step 606 is then further followed by a third step 608 at which the first and second condensate pumps (or pump skids) 326 and 328 are set. Further, following the third step 608 is a fourth step 610 including first, second, and third substeps 612, 614, and 616, respectively (which can be performed substantially simultaneously or in parallel as illustrated, or alternatively sequentially). The make-up (or demin) water control skid (or station) 316 is installed at the first substep 612, and the condensate water control skid (or station) 312 is installed at the second substep 614. Further, at the third substep 616, interconnecting piping from the control skids (or valve skids) 312 and 316 to the condensate storage tank 308 and further with respect to the condensate (or feedwater) pumps 326 and 328, including the input pipes 313 and 317 and the output pipes 322 and 324, is installed.

As for the second branch of steps 620, this branch of steps begins with a fifth step 622 at which the auxiliary boiler 302 (or auxiliary boiler pressure vessel) is set at a second position. The second position at which the auxiliary boiler 302 is set is typically is different from the first position at which the condensate tank support structure is set at the first step 604. The fifth step 622 is followed by a sixth step 624 at which the deaerator 306 is set on top of (and directly coupled to, and/or integrally formed with) the auxiliary boiler. In embodiments entailing a condensate heater, such as that of FIG. 3 and FIG. 4, the coupling of the deaerator 306 to the auxiliary boiler 302 can be understood as setting on top of (and with respect to) the auxiliary boiler 302 a deaerator heater section as noted in FIG. 6. Next, at a seventh step 626 the boiler feedwater control skid (or station) 342 is set, and this in turn is followed by an eighth step 628 at which interconnecting piping from the boiler feedwater control skid to the auxiliary boiler 302 and associated deaerator 306 is installed. Depending upon the embodiment, the interconnecting piping installed at the eighth step 628 can be understood to include any of one or more pipes or pipe portions. For example, with reference to the embodiment of FIG. 3, the interconnecting piping installed at the eighth step 628 can be understood to include all of the piping by which the boiler feedwater control skid 342, condensate heater 346, and input port 352 of the deaerator 306 are linked, including each of the fourth pipe portion 340, the additional pipe 350, and the bypass pipe 354 (as well as the control valves 356, 358, and 360).

Finally, upon the completion of all of the steps (and substeps) of the first and second branches of steps 602 and 620, the auxiliary boiler system installation process is completed at a final step 630, at which remaining interconnecting piping is installed so as to complete the assembly (or coupling) of the condensate tank-related structures assembled by way of the first branch of steps and auxiliary boiler-related structures (including the deaerator 306) assembled by way of the second branch of steps so as to form the overall improved auxiliary boiler system 300 (the final step 630 can also be considered to be a final step of either of the first and second branches of steps). For example, the final step 630 can include installation of the first, second, and third pipe portions 334, 336, and 338 linking the condensate pumps 326 and 328 with the boiler feedwater control skid 342.

Although the flow chart 600 of FIG. 6 is particularly intended to be representative of an example process for installing the improved auxiliary boiler system 300 of FIG. 3 and FIG. 4, it should be recognized that this flow chart is also substantially representative of an example process for installing the modified version of the improved auxiliary boiler system of FIG. 5. More particularly, the flow chart 600 does not make specific reference to condensate heater 346 of the improved auxiliary boiler system 300 of FIG. 3 and FIG. 4 except for the mentioning of a deaerator heater section in regard to the sixth step 624. Therefore, when the process of FIG. 6 is utilized to install the modified version of the improved auxiliary boiler system corresponding to FIG. 5, it should be appreciated that the process does not include any step or substep (e.g., at the sixth step 624 or otherwise) involving installation of the condensate heater. Further in such circumstance, the interconnecting piping installed at the eighth step 628 can merely include a pipe portion linking the boiler feedwater control skid 342 with the deaerator 306 such as the pipe portion 504 rather than including any piping enabling implementation of a condensate heater.

In addition to the above-described embodiments, it should be recognized that the present disclosure encompasses numerous other embodiments and variations of the embodiments described above. For example, in additional embodiments encompass herein, different numbers of components or arrangements of components can be present. For example, although the auxiliary boiler system 300 of FIG. 3 is shown to include the condensate pumps 126 and 128, in other embodiments only one of these pumps or more than two of these pumps can be implemented. More generally, although the auxiliary boiler system 300 of FIG. 3 includes the condensate storage tank 308 (and associated pumps, valve skids, and interconnecting piping), the present disclosure is also intended to encompass embodiments in which no condensate storage tank (or pumps, valve skids, and interconnecting piping associated with such a condensate storage tank) is present. In some such embodiments, the integrated assembly of the auxiliary boiler 302 and deaerator 306 is provided merely with make-up water and not provided with condensate.

Further, in some such embodiments, the make-up water can be provided to the integrated assembly of the auxiliary boiler 302 and deaerator 306 (including the fourth pipe portion 340 or pipe portion 504) from a feedwater tank by way of the feedwater control skid 342. That is, an interconnecting pipe at least indirectly coupled to the feedwater tank (e.g., by way of one or more pumps) can be coupled to the feedwater control skid 342 in place of the third pipe portion 338, and feedwater can flow by way of that interconnecting pipe to the feedwater control skid and then ultimately, via the fourth pipe portion 340 or pipe portion 502, to the input port 332 of the condensate heater 346 or to the deaerator input port 352. Although in such embodiments the feedwater tank will only be providing feedwater in the form of make-up water to the integrated assembly of the auxiliary boiler 302 and deaerator 306, it should be appreciated that the term feedwater tank can more generally refer not only to a tank that only provide make-up water as feedwater but also to tanks that provide other types of feedwater, including for example condensate. Thus, it should be appreciated that, although not all feedwater tanks can be considered condensate storage tanks, condensate storage tanks such as the condensate storage tank 308 of FIG. 3 can also be considered feedwater tanks.

Also for example, although not described above, it should be appreciated that one or more control devices (including possibly computerized or processor-based control devices) can be employed to control one or more operations of auxiliary boiler systems such as the auxiliary boiler system 300. Such controller operations can, for example, control over the actuation of the condensate pumps 126, 128, control over the actuation of the boiler feedwater control skid 342, and control of the actuation of the control valves 356, 358, and 360 that determine whether the condensate heater 346 is bypassed.

Further for example, the present disclosure is intended to encompass numerous other processes or manners of installation or operation in addition to those described above. Additionally for example, in one additional embodiment, the present disclosure relates to a method of operating an auxiliary boiler system. The method includes providing a deaerator coupled directly to and integrated with the auxiliary boiler, and a condensate storage tank coupled at least indirectly to the deaerator. The method further includes causing feedwater from the condensate storage tank to flow directly or substantially directly to the deaerator, where an amount of the feedwater received at the deaerator is controlled at least in part by way of a boiler feedwater control skid fluidly coupled between the condensate storage tank and the deaerator. The method additionally includes, after being deaerated by the deaerator, communicating the feedwater from the deaerator to the auxiliary boiler by way of a first conduit. Further, in some such embodiments, the method also includes heating the feedwater by way of a condensate heater positioned within the auxiliary boiler, where the feedwater is caused to flow from the condensate storage tank to the condensate heater and then subsequently to the deaerator. Additionally, in some such embodiments, the method further includes one or both of: actuating one or more control valves so that the condensate heater is bypassed and additional feedwater is caused to flow from the condensate storage tank to the deaerator without passing through the condensate heater; or permitting pegging steam to pass from the auxiliary boiler into the deaerator by way of a second conduit therebetween.

In view of the above description, it should be appreciated that improved auxiliary boiler systems and methods encompassed herein such as those of FIG. 3, FIG. 4, FIG. 5, and FIG. 6 can be advantageous by comparison with conventional auxiliary boiler systems and methods in one or more respects. For example, the improved auxiliary boiler system of FIG. 3 and FIG. 4, as well as the modified version thereof corresponding to FIG. 5, achieve reduced complexity at least in part by avoiding the inclusion of certain components/features that may be present in conventional auxiliary boiler systems but that would be redundant or unnecessary if included in the improved auxiliary boiler system. As mentioned above, in at least some embodiments encompassed herein, the improved auxiliary boiler system avoids the need for both a condensate storage tank and an additional feedwater storage tank given the repurposing of the condensate storage tank as a feedwater storage tank. Additionally, in some embodiments encompassed herein, neither an economizer nor any associated piping or ducts are implemented. That is, in contrast to conventional embodiments employing economizers, the economizer can be entirely eliminated from such improved auxiliary boiler systems, and no boiler-to-economizer duct or piping is employed.

Relatedly, the process(es) for installing the improved auxiliary boiler systems encompassed herein can be considerably simpler, less time-consuming, and less costly than the process(es) for installing conventional auxiliary boiler systems such as that of FIG. 1. Indeed, the process shown in FIG. 1 concerning installation of a conventional auxiliary boiler system entails the first, second, and third branches of steps 202, 220, and 240, respectively (plus the step 238), relating to the installation of condensate tank-related structures, deaerator storage tank-related structures, and auxiliary boiler-related structures (including the economizer), respectively, but in contrast the process of FIG. 6 concerning installation of the improved auxiliary boiler system 300 merely entails the first and second branches of steps 602 and 620, respectively (plus the step 630), relating to the installation of condensate tank-related structures and auxiliary boiler-related (including deaerator) structures.

Further, in at least some embodiments encompassed herein including the improved auxiliary boiler system 300, a condensate heater such as the condensate heater 346 is positioned within the auxiliary boiler 302. Positioning of the condensate heater in this manner allows for effective heating of the condensate/feedwater being provided to the deaerator 306 and further allows for a compact boiler package with reduced-complexity piping. Additionally, in some such embodiments, a provision for bypassing the condensate heater is furnished to afford the customer/operator the option of bypassing the condensate heater/heat transfer section if appropriate in view of operational circumstances or constraints—for example, during cold start up circumstances (or potentially if a tube is not operating in a desired manner) to avoid excessive condensation.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. An auxiliary boiler system for use in conjunction with a main steam source, the auxiliary boiler system comprising:
   an auxiliary boiler;
   a deaerator coupled directly to and integrated with the auxiliary boiler;
   a condensate storage tank coupled at least indirectly to the deaerator; and
   a condensate heater positioned within the auxiliary boiler, wherein the condensate storage tank is fluidly coupled to the condensate heater so as to allow for first fluid flow therebetween, and the condensate heater is additionally fluidly coupled to the deaerator so as to allow for second fluid flow therebetween.

2. The auxiliary boiler system of claim 1, wherein the condensate storage tank is coupled directly or at least substantially directly to the deaerator by way of at least one pump, a feedwater control device, and a condensate heater assembly.

3. The auxiliary boiler system of claim 1, wherein the condensate storage tank is coupled directly or at least substantially directly to the deaerator only by way of at least one pump, at least one feedwater control device, and one or more pipes or piping portions that are configured to directly link the at least one pump with the condensate storage tank, directly link the at least one pump with the at least one feedwater control device, and either (a) directly link the at least one feedwater control device with the deaerator or (b) indirectly link the at least one feedwater control device with the deaerator by way of a condensate heater assembly.

4. The auxiliary boiler system of claim 1, wherein the condensate heater is fluidly coupled to the condensate storage tank by way of a feedwater control skid and at least one pump.

5. The auxiliary boiler system of claim 4, further comprising a bypass pipe arrangement that can be operated so that, in at least one circumstance, the feedwater control skid is fluidly coupled with the deaerator in a manner that bypasses the condensate heater.

6. The auxiliary boiler system of claim 4, wherein the condensate heater is only used if thermal efficiency is a critical parameter for the plant.

7. The auxiliary boiler system of claim 1, wherein each of the first fluid flow and the second fluid flow includes respective un-deaerated feedwater flow and the first fluid flow is equal in magnitude to the second fluid flow.

8. The auxiliary boiler system of claim 1, wherein the deaerator is coupled to the auxiliary boiler by way of a structure including a first conduit and a second conduit.

9. The auxiliary boiler system of claim 8, wherein the first conduit is configured to allow deaerated feedwater to proceed from the deaerator to the auxiliary boiler and the second conduit is configured to allow pegging steam to proceed from the auxiliary boiler to the deaerator.

10. The auxiliary boiler system of claim 9, wherein the structure includes a connecting flange/nozzle arrangement having a nozzle portioned with a splitter plate configured to allow the pegging steam and deaerated feedwater to respectively flow on respective opposite sides of the splitter plate.

11. The auxiliary boiler system of claim 1, wherein the auxiliary boiler includes each of a steam drum and a burner/windbox arrangement, wherein the steam drum has an oversized water holding capacity to establish steaming before needing feedwater during cold starts.

12. The auxiliary boiler system of claim 1, wherein the auxiliary boiler receives feedwater from the deaerator and the deaerator receives pegging steam from the auxiliary boiler, and wherein the auxiliary boiler is an industrial water tube (IWT) boiler.

13. A method of implementing an auxiliary boiler system for use in conjunction with a main steam source, the method comprising:
   setting a condensate storage tank in relation to a first support structure at a first position;
   setting an auxiliary boiler at a second position;
   directly coupling a deaerator to the auxiliary boiler so that the deaerator is integrated with the auxiliary boiler;
   installing at least one interconnection by which the condensate storage tank is at least indirectly coupled to the deaerator, wherein the installing includes further installing at least one pipe portion by which a condensate heater is additionally coupled between the condensate storage tank and the deaerator; and
   setting a condensate tank pump skid, wherein the condensate heater is fluidly coupled to the condensate storage tank by way of a control skid and at least one feedwater pump, and wherein the installing includes additionally installing a bypass pipe arrangement that can be operated so that, in at least one circumstance, the control skid is directly fluidly coupled with the deaerator in a manner that bypasses the condensate heater.

14. The auxiliary boiler system of claim 13, wherein the deaerator is coupled to the auxiliary boiler by way of a structure including a first conduit and a second conduit, wherein the first conduit is configured to allow deaerated feedwater to proceed from the deaerator to the auxiliary boiler, and wherein the second conduit is configured to allow pegging steam to proceed from the auxiliary boiler to the deaerator.

15. A method of operating an auxiliary boiler system, the method comprising:
   providing a deaerator coupled directly to and integrated with the auxiliary boiler, and a condensate storage tank coupled at least indirectly to the deaerator;
   causing feedwater from the condensate storage tank to flow directly or substantially directly to the deaerator, wherein an amount of the feedwater received at the deaerator is controlled at least in part by way of a boiler feedwater control skid fluidly coupled between the condensate storage tank and the deaerator;
   after being deaerated by the deaerator, communicating the feedwater from the deaerator to the auxiliary boiler by way of a first conduit; and
   heating the feedwater by way of a condensate heater positioned within the auxiliary boiler, wherein the feedwater is caused to flow from the condensate storage tank to the condensate heater and then subsequently to the deaerator.

16. The method of claim 15, further comprising one or both of:
   (a) actuating one or more control valves so that the condensate heater is bypassed and additional feedwater is caused to flow from the condensate storage tank to the deaerator without passing through the condensate heater; or
   (b) permitting pegging steam to pass from the auxiliary boiler into the deaerator by way of a second conduit therebetween.

* * * * *